US008698581B2

(12) United States Patent
Han et al.

(10) Patent No.: US 8,698,581 B2
(45) Date of Patent: Apr. 15, 2014

(54) AUTOMATICALLY CONTROLLABLE, FREQUENCY TUNABLE FILTER

(75) Inventors: Sang-Ho Han, Incheon-si (KR); Won-Jae Lee, Incheon-si (KR)

(73) Assignee: Ace Technologies Corporation (KR)

( * ) Notice: Subject to any disclaimer, the term of this patent is extended or adjusted under 35 U.S.C. 154(b) by 159 days.

(21) Appl. No.: 13/384,934

(22) PCT Filed: Jul. 20, 2010

(86) PCT No.: PCT/KR2010/004741

§ 371 (c)(1),
(2), (4) Date: Jan. 19, 2012

(87) PCT Pub. No.: WO2011/010853

PCT Pub. Date: Jan. 27, 2011

(65) Prior Publication Data

US 2012/0302189 A1 Nov. 29, 2012

(30) Foreign Application Priority Data

Jul. 20, 2009 (KR) ..... 10-2009-0065777

(51) Int. Cl.
*H01P 1/20* (2006.01)

(52) U.S. Cl.
USPC ..... 333/203; 455/71; 455/87

(58) Field of Classification Search
USPC ..... 333/207, 235, 224; 455/71, 87, 180.3
See application file for complete search history.

(56) References Cited

U.S. PATENT DOCUMENTS

| | | | | |
|---|---|---|---|---|
| 5,235,294 | A | 8/1993 | Ishikawa et al. | |
| 7,825,753 | B2 * | 11/2010 | Park et al. | 333/203 |
| 2003/0122635 | A1 | 7/2003 | Borzenets et al. | |
| 2008/0160939 | A1 * | 7/2008 | Sheng et al. | 455/150.1 |
| 2009/0058563 | A1 | 3/2009 | Seo et al. | |

FOREIGN PATENT DOCUMENTS

| | | | |
|---|---|---|---|
| JP | 05-041604 | A | 2/1993 |
| KR | 10-2004-0071277 | A | 8/2004 |
| KR | 10-2005-0020928 | A | 3/2005 |
| KR | 10-0887213 | B1 | 3/2009 |

* cited by examiner

*Primary Examiner* — Creighton Smith
(74) *Attorney, Agent, or Firm* — AlbertDhand LLP

(57) ABSTRACT

A frequency tunable filter is disclosed. The disclosed filter comprises a filter unit having a sliding member so as to be capable of tuning a frequency band of a frequency signal being filtered; a communication module configured to receive a control signal for controlling the tuning of the frequency band; and a control unit configured to control the tuning of the frequency band by moving the sliding member based on the control signal. With the disclosed filter, the tuning of the filter may be performed automatically by way of control signals transmitted from a remote location.

12 Claims, 9 Drawing Sheets

AUTOMATICALLY CONTROLLABLE, FREQUENCY TUNABLE FILTER

TECHNICAL FIELD

The present invention relates to a filter, more particularly to a tunable filter in which the band-pass characteristics of the filter, such as the filter's center frequency and bandwidth, can be varied.

BACKGROUND ART

A filter is a device for passing (filtering) signals of only a certain frequency band from among the inputted frequency signals, and is implemented in various ways. The band-pass frequency of an RF (radio frequency) filter may be determined by the inductance and capacitance components of the filter, and the operation of adjusting the band-pass characteristics of a filter is referred to as tuning.

Certain frequency bands may be allotted to businesses dealing with communication systems, such as mobile communication systems, where such communication businesses may divide the allotted frequency bands into several channels for use. In the related art, communication businesses generally manufactured and used a separate filter that is for suitable for each frequency band.

In recent times, however, rapid changes in the communication environment have created a need for a filter to have variable properties, such as for the center frequency and bandwidth, for example, unlike the earlier environment for mounting filters. For varying the properties in this manner, a tunable filter may be used.

FIG. 1 illustrates the structure of a tunable filter according to the related art.

Referring to FIG. 1, a filter according to the related art may include a housing 110, an input connector 120, an output connector 130, a cover 140, and multiple numbers of cavities 150 and resonators 160.

A number of walls may be formed within the housing 110, with the walls defining cavities 150 in which to hold the resonators, respectively. The cover 140 may include tuning bolts 170, as well as joining holes for joining the housing 110 with the cover 140.

The tuning bolts 170 may be coupled to the cover 140 and may penetrate inside the housing. The tuning bolts 170 may be arranged on the cover 140 in corresponding positions in relation to the resonators or in relation to particular positions inside the cavities.

RF signals (or frequency signals) may be inputted by way of the input connector 120 and outputted by way of the output connector 130, where the RF signals may progress to the next cavity 150 through the coupling window formed in each cavity 150. Each of the cavities 150 and resonators 160 may generate a resonance effect of the RF signals, so that the RF signals may thus be filtered by this resonance effect.

In a filter according to the related art, such as that shown in FIG. 1, the tuning of frequency characteristics such as center frequency and bandwidth may be achieved using the tuning bolts 170.

FIG. 2 is a cross-sectional view of a cavity in a filter according to the related art.

Referring to FIG. 2, a tuning bolt 170 may penetrate through the cover 140 to be located above a resonator 160. The tuning bolt 170 may be made of a metallic material and may be secured to the cover 140 by way of screw-joining.

Hence, the tuning bolt 170 can be rotated to adjust its distance to the resonator 160, and by thus varying the distance between the resonator 160 and the tuning bolt 170, tuning may be achieved. The tuning bolt 170 can be rotated manually, or a separate machine can be employed for rotating the tuning bolt. If the tuning is achieved at an appropriate position, the tuning bolt 170 may be secured by a nut.

In a filter according to the related art, rotating the tuning bolt 170 to vary the distance between tuning bolt 170 and the resonator 160 also causes the capacitance to vary. Capacitance is one of the parameters that determine the frequency of a filter, and therefore the center frequency of a filter can be changed by altering the capacitance.

With such a filter according to the related art, tuning is possible only at the initial fabrication stage, and its structure makes it difficult to accomplish tuning during use. In order to solve such difficulties, a tunable filter was proposed which employs a sliding system, with which tuning can be performed more easily.

For a tunable filter using a sliding system, a sliding member capable of sliding is installed between the cover 140 and the resonators 160, and tuning elements made of metallic or dielectric material are attached to a lower portion of the sliding member, after which the frequency band characteristics of the filter, such as resonance frequency and bandwidth, may be tuned by the sliding motion of the sliding member. The sliding member can be made to slide automatically using a motor, or can also be made to slide manually by a user.

Such a tunable filter using a sliding system has the advantage of enabling tuning just by moving the sliding member left and right.

With a tunable filter using a sliding member, however, there is the problem that, in order to obtain the band-pass characteristics desired by the user, each and every motor has to be rotated while checking whether or not the desired band-pass characteristics are provided. In particular, if the tunable filter is installed in a region such as a mountainous area that is not easy to access, there is difficulty involved in having to actually reach the location where the tunable filter is installed when tuning the band-pass characteristics.

DISCLOSURE

Technical Problem

To resolve the problems of the related art addressed above, an embodiment of the invention is to provide a frequency tunable filter with which the filter's band-pass characteristics can be tuned automatically.

Another objective of the present invention is to provide a frequency tunable filter with which the filter's band-pass characteristics can be tuned from a remote location without having to actually visit the location where the tunable filter is installed.

Technical Solution

In order to achieve the above objectives, an aspect of the present invention provides a frequency tunable filter enabling automatic control that includes: a filter unit having a sliding member so as to be capable of tuning a frequency band of a frequency signal being filtered; a communication module configured to receive a control signal for controlling the tuning of the frequency band; and a control unit configured to control the tuning of the frequency band by moving the sliding member based on the control signal.

The control unit may include: a processor configured to provide a control such that the sliding member is moved by a preset reference distance when the control signal is received;

an RF signal generator configured to generate a frequency signal intended for tuning according to the control of the processor; and an RF signal detector configured to detect an output signal power of the filter unit for the frequency signal generated at the RF signal generator, where the processor may be configured to compare a detected power of the RF signal detector with a preset threshold value and repeat the comparing of the detected power and the threshold value while moving the sliding member by the reference distance until the detected power is greater than the preset threshold value.

The control unit can further include: a first coupler configured to input the frequency signal generated at the RF signal generator to an input connector of the filter unit by way of coupling; and a second coupler configured to provide an output signal of the filter unit from an output connector of the filter unit to the RF signal detector by way of coupling.

The frequency signal intended for tuning may preferably be a center frequency signal of a frequency band intended for tuning.

The RF signal generator can include a PLL chip.

The communication module can receive the control signal from a control server positioned in a remote location and can include an Ethernet module.

The sliding member may be joined to a motor to slide in correspondence with a rotation of the motor, and the processor may control a driving of the motor to move the sliding member by the reference distance.

Another aspect of the present invention provides a frequency tunable filter enabling automatic control that includes: a filter unit having a sliding member so as to be capable of tuning a frequency band of a frequency signal being filtered; a processor configured to provide a control such that the sliding member is moved by a preset reference distance according to a control signal for tuning to the particular frequency band; an RF signal generator configured to generate a frequency signal intended for tuning according to the control of the processor; and an RF signal detector configured to detect an output signal power of the filter unit for the frequency signal generated at the RF signal generator, where the processor is configured to compare a detected power of the RF signal detector with a preset threshold value and repeat the comparing of the detected power and the threshold value while moving the sliding member by the reference distance until the detected power is greater than the preset threshold value.

Yet another aspect of the present invention provides an automatic filter tuning method in a tunable filter, which is equipped with a filter unit, a processor, an RF signal generator, an RF signal detector, and a sliding member, the method comprising: (a) providing to the processor a control signal for tuning, the control signal including information of a frequency band intended for tuning; (b) moving the sliding member by a preset reference distance by way of a control of the processor; (c) generating a frequency signal at the RF signal generator corresponding to the frequency band intended for tuning, and inputting the frequency signal to the filter unit; and (d) detecting a power of an output signal of the filter unit at the RF signal detector and comparing the power of the output signal with a preset threshold value, where tuning is completed if, in said step (d) of comparing the detected power with the preset threshold value, the detected power exceeds the preset threshold value, and where if the detected power does not exceed the preset threshold value, said step (b) through said step (d) are repeated to determine whether or not appropriate tuning is achieved.

Advantageous Effects

According to certain embodiments of the present invention, the tuning of a filter may be performed automatically by way of control signals transmitted from a remote location.

MODE FOR INVENTION

Figure 1:
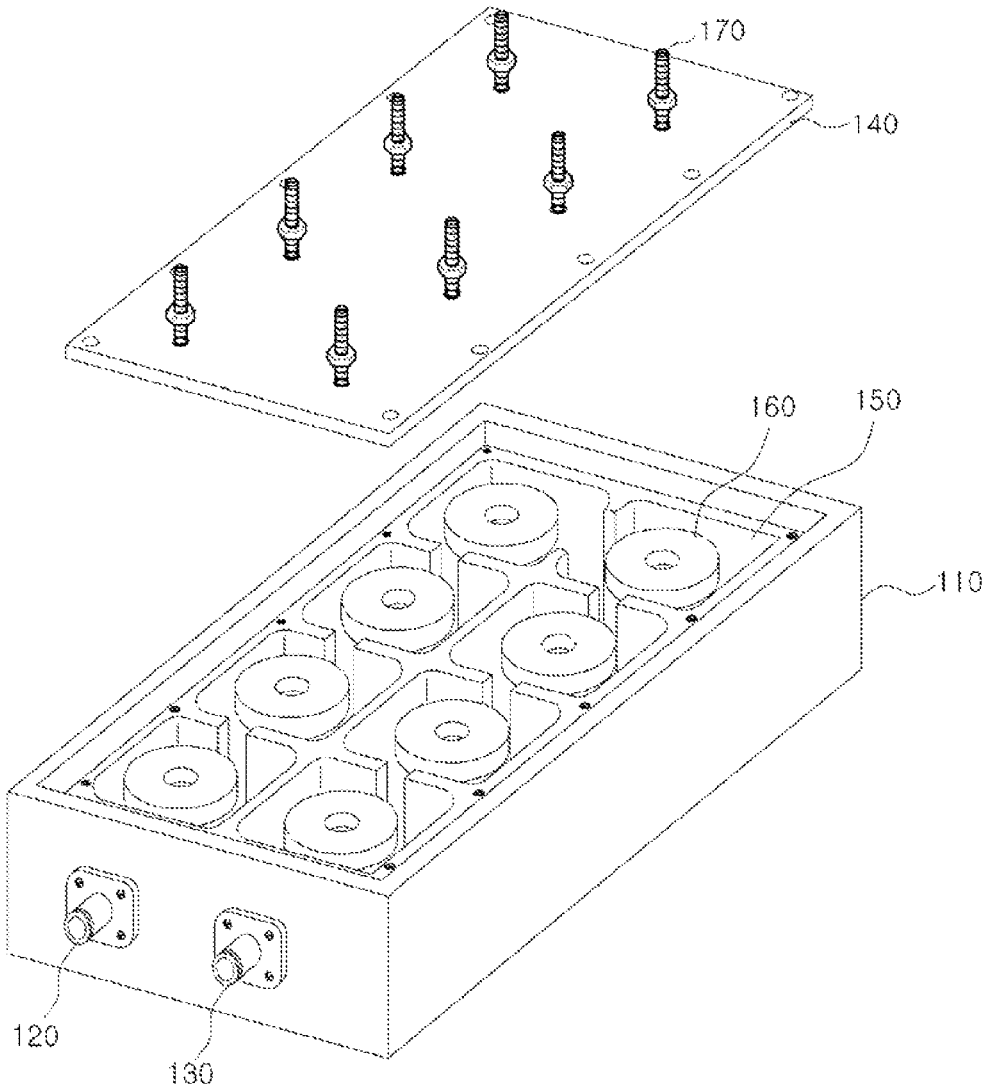
FIG. 1 illustrates the structure of a filter according to the related art.
Figure 2:
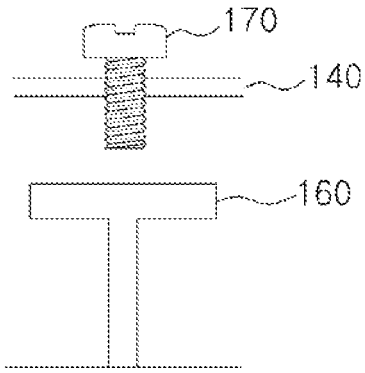
FIG. 2 is a cross-sectional view of a cavity in a filter according to the related art.

Certain preferred embodiments of the invention will be described below in more detail with reference to the accompanying drawings. For the sake of easier understanding, those components that are the same or are in correspondence are rendered the same reference numeral regardless of the figure number.

Figure 3:
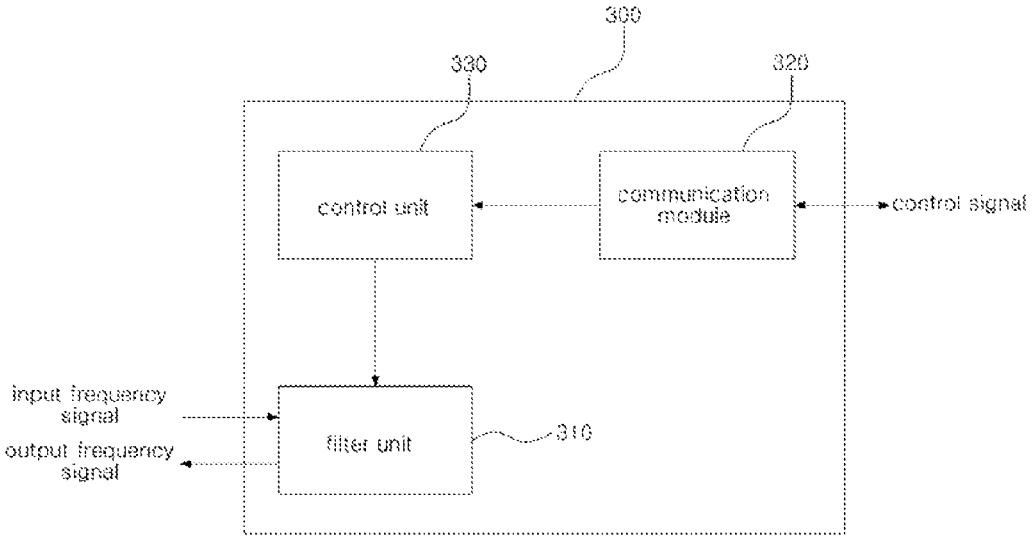
FIG. 3 is a block diagram illustrating the detailed composition of a frequency tunable filter according to an embodiment of the present invention.

FIG. 3 is a block diagram illustrating the detailed composition of a frequency tunable filter 300 according to an embodiment of the present invention.

A frequency tunable filter 300 according to an embodiment of the present invention can include a filter unit 310, a communication module 320, and a control unit 330. The functions of each component will be described below in more detail.

The filter unit 310 may allow passage for signals of only a particular frequency band, from among the frequency signals inputted. The filter unit 310 may be structured to use a sliding member, etc., to alter the internal structure of the filter and thereby allow tuning for the frequency band being filtered.

The communication module 320 may receive a control signal for tuning the frequency band, and the control unit 330 may control the tuning of the frequency band based on the received control signal.

In this case, the control signal can be a signal transmitted from a control server installed in a remote location, that is, in a region far away from where the frequency tunable filter 300 is installed.

In other words, if the frequency tunable filter 300 is installed in a remote area that is difficult for a person to access, as mentioned earlier, there used to exist the inconvenience of an administrator having to personally visit the area where the frequency tunable filter is installed and to perform a tuning operation. However, if a frequency tunable filter 300 according to an embodiment of the present invention is used, the administrator can easily tune the frequency band of the frequency tunable filter 300 just by generating a control signal for controlling the tuning of the frequency band from a remote location, transmitting the control signal to the frequency tunable filter 300, and controlling the frequency tuning by way of the control unit 330.

Here, the control unit 330 can control the tuning of the frequency band by altering the structure of the filter unit 310.

According to an embodiment of the present invention, the control unit 330 may perform tuning for the filter by determining whether or not filtering is performed for the desired frequency band while changing the structure of the filter unit 310. That is, the control unit 330 may receive information on the frequency band intended for tuning through the communication module, and then determine whether or not there is appropriate filtering at the frequency band intended for tuning while altering the position of the component for filter tuning, such as a sliding bar; if there is appropriate filtering, the tuning operation may be completed.

Here, the control unit 330 can determine whether or not there is appropriate filtering being performed from whether or not a center frequency signal of the frequency band intended for tuning passes the filter at or above a preset power.

For this purpose, the control unit 330 may be equipped with a device that can input a particular frequency signal into the filter unit 310 and that can detect the level of an outputted signal. The detailed composition of the control unit 330 will be described later with reference to a separate drawing.

The tuning action of a frequency tunable filter equipped with a filter unit 310 that includes a sliding member will be described below in more detail, with reference to FIG. 4.

Figure 4:
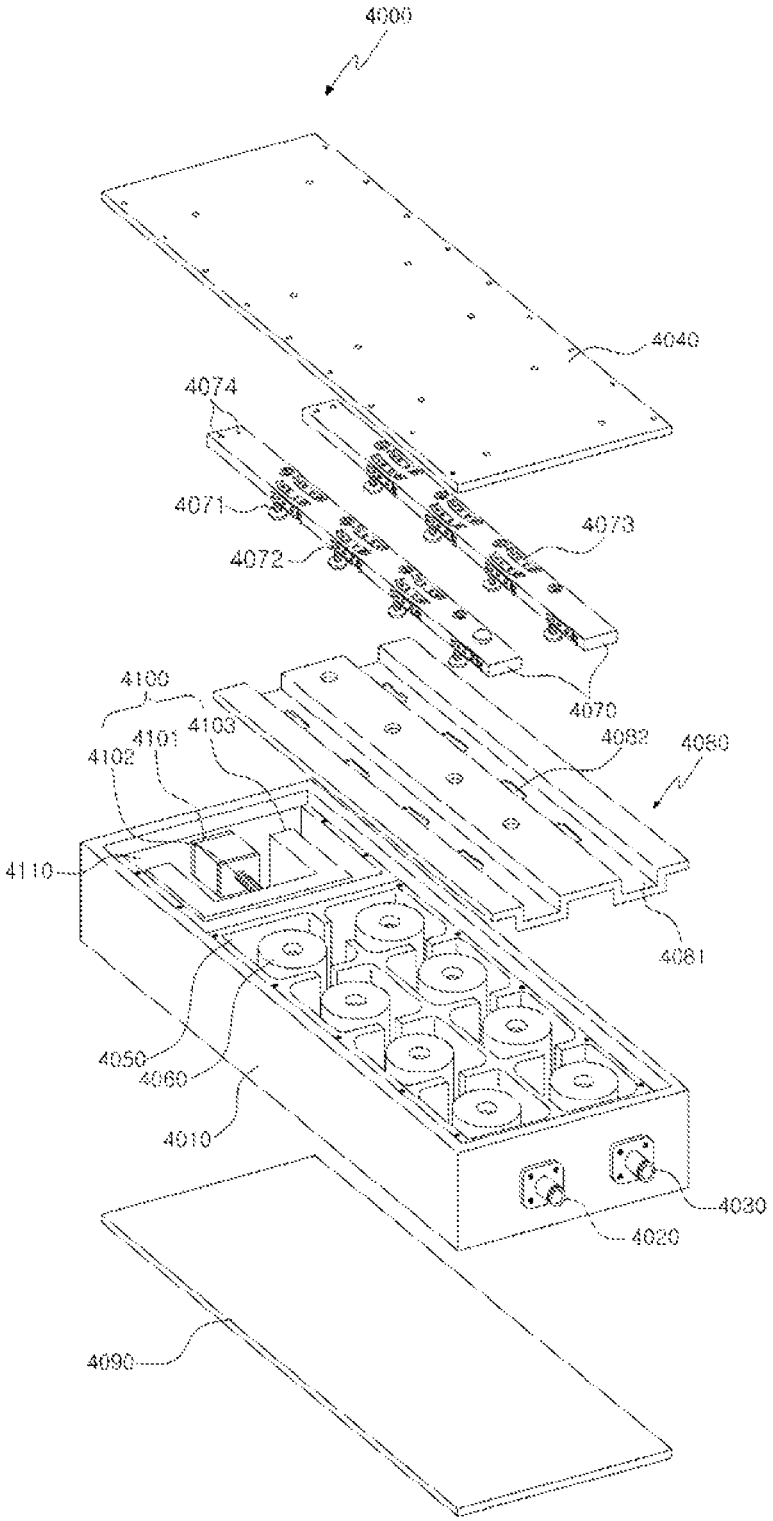
FIG. 4 is an exploded perspective view of a frequency tunable filter using a sliding method according to an embodiment of the present invention.

FIG. 4 is an exploded perspective view of a frequency tunable filter 4000 using a sliding method according to an embodiment of the present invention.

A frequency tunable filter using a sliding method according to an embodiment of the present invention may include a housing 4010, an input connector 4020, an output connector 4030, a main cover 4040, multiple cavities 4050, multiple resonators 4060, sliding members 4070, a sub-cover 4080, a driving unit 4100, and a circuit board 4110.

The housing 4010 may serve to protect the components inside the filter, such as the resonators, and to provide shielding from electromagnetic waves.

A housing made by forming a base of aluminum material and applying plating over the base can be used for the housing 4010. For RF equipment such as filters and waveguides, silver plating is typically used, which provides superior electrical conductivity, in order to minimize loss. In recent times, other types of plating besides silver plating are also being used, to improve characteristics such as corrosion resistance, and a housing finished with such plating types can also be used.

There may be multiple partition walls formed inside the frequency tunable filter 4000, and such partition walls, together with the housing 4010, may define the cavities 4050 in which the resonators 4060 are contained.

The number of cavities 4050 and of resonators 4060 is related to the order of the filter, and FIG. 4 illustrates an example in which the order is 8, that is, there are eight resonators. The order of the filter is related to skirt characteristics and insertion loss. Here, the skirt characteristics and insertion are in a trade-off relationship. That is, a higher order of the filter leads to better skirt characteristics, but worse insertion loss. Consequently, the order of the filter (that is, the number of cavities 4050 and of resonators 4060) may be determined by the skirt characteristics and the insertion loss required.

In some of the partition walls, coupling windows may be formed corresponding to the direction in which the RF signals (or frequency signals) proceed. RF signals resonated by a cavity 4050 and a resonator 4060 may proceed to the next cavity through the coupling window.

The main cover 4040 and the sub-cover 4080 may be joined to an upper portion of the housing 4010, and may be joined to the housing 4010 by screw-joints applied to multiple fastening holes. The sub-cover 4080 may include guide grooves 4081 that allow the sliding members 4070 to slide in a stable manner.

The sliding members 4070 may be installed so as to be capable of sliding along a direction orthogonal to the direction in which the resonators 4060 stand, that is, along a horizontal direction. In this case, the sliding members 4070 may be installed in the guide grooves 4081 formed in an upper portion of the sub-cover 4080.

The number of sliding members 4070 can correspond to the number of lines of resonators formed in the filter. FIG. 4 illustrates a filter having two lines of four resonators, and correspondingly, the number of sliding members 4070 is shown to be two. Of course, the sliding members can have an integrated structure, unlike the example shown in the illustration.

Tuning elements 4071 may be joined to a lower portion of the sliding members 4070. The tuning elements 4071 may go through elongated holes 4082 formed in the sub-cover 4080 into the interior of the filter. An elongated hole 4082 may have a particular length in the sliding direction of the sliding member, where the length in the sliding direction may be set in consideration of the sliding range of the sliding member. Either a metallic or a dielectric material can be used for the tuning elements 4071. However, a dielectric material may be preferable as the material for the sliding members 4070.

The tuning elements 4071 may be joined to a lower portion of the sliding members 4070, with each resonator being equipped with a corresponding tuning element. At a lower portion of each sliding member 4070 there may be four resonators, and hence, four tuning elements may be joined to each sliding member 4070. Also, the interval in which the tuning elements are installed may correspond to the interval in which the resonators 4060 are installed.

The positions of the tuning elements 4071 joined in correspondence with the sliding of the sliding members 4070 may also vary. The tuning elements 4071 may form capacitance through interaction with the resonators 4060, and when the positions of the tuning elements 4071 are changed, so also may the capacitance change.

As capacitance is determined by the distance and area of overlap between two metallic objects, varying the positions of the tuning elements of metallic material may cause the area of overlap between the resonators and tuning elements to change also, making it possible to vary the capacitance and thus tune the filter. If tuning elements of a dielectric material are used, the varying of capacitance may be achieved by changes in the dielectric constant for forming the capacitance.

The tuning action of a filter according to the sliding of the sliding members will be described below in more detail, with reference to FIG. 5.

Figure 5:
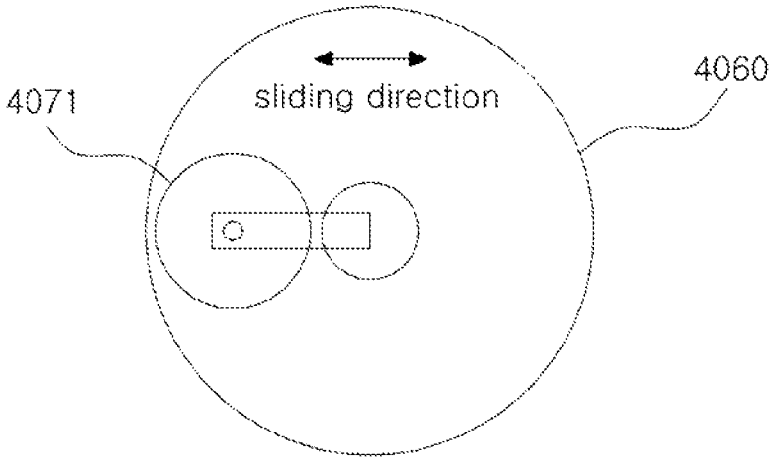
FIG. 5 is a diagram demonstrating how the area of overlap between a tuning element and a resonator changes according to the sliding of the sliding member.

FIG. 5 is a diagram demonstrating how the area of overlap between a tuning element 4071 and a resonator 4060 changes according to the sliding of the sliding member 4070.

As the sliding member 4070 slides, the tuning elements 4071 joined thereto may also slide. As the tuning elements 4071 move, the range of overlapping between the upper portions of the resonators 4060 and the tuning elements 4071 may change, and accordingly, the capacitance value, for which the area of overlap is a parameter, may also change.

While FIGS. 4 and 5 illustrate the resonators 4060 in the shape of a disc and the tuning elements 4071 in the shape of a discus, this is merely one example, and the resonators 4060 and tuning elements 4071 can be implemented in a variety of shapes.

Referring again to FIG. 4, the frequency tunable filter 4000 according to an embodiment of the present invention will be described below in more detail.

Multiple first guide members 4072 can be joined to one side of a sliding member 4070, while multiple second guide members 4073 can be joined to an upper portion of the sliding member 4070. The first guide members 4072 and the second guide members 4073 may be joined in order to limit unnecessary movement of the sliding member 4070.

In other words, the sliding member 4070 should only slide along a lengthwise (longitudinal) direction, and any up-and-down movement or lateral movement during sliding should be eliminated. For this purpose, the first guide members 4072 and the second guide members 4073 may eliminate unnecessary movement in the up-and-down or lateral directions, and may enable the sliding member to slide only along the preset direction.

In other words, the first guide members 4072 and the second guide members 4073 may perform the function of guiding the sliding member 4070 to slide in a stable manner in the guide groove 4081 in an upper portion of the sub-cover 4080. In this case, the first guide members 4072 and the second guide members 4073 may be composed of an elastic material, and may preferably be implemented as flat springs.

While FIG. 4 illustrates an example in which the first guide members 4072 are joined only on one side, the first guide members 4072 can also be joined on both sides of the sliding member 4070.

Also, while FIG. 4 depicts the sliding members 4070 as sliding on the guide groove 4081 in the sub-cover 4080, the sliding member 4070 can also be made to slide while installed directly between the main cover 4040 and the resonators 4060. In this case, the sub-cover 4080, the first guide members 4072, and the second guide members 4073 may not be installed.

A circuit for the communication module and the control unit may be implemented on a circuit board 4090. The circuit board can be joined to a lower portion of the filter unit but is not thus limited.

The structure of the filter unit illustrated in FIG. 4 and FIG. 5 is just one example of a tunable filter to which the automatic tuning system of the present invention can be applied. It will be apparent to those skilled in the art that the automatic tuning system of the present invention can be applied to various types of tunable filters.

In one example, a PCB (print circuit board) can be used for the circuit board 4090.

The structure of a circuit board 4090 according to an embodiment of the present invention will be described below in more detail with reference to FIG. 6.

Figure 6:
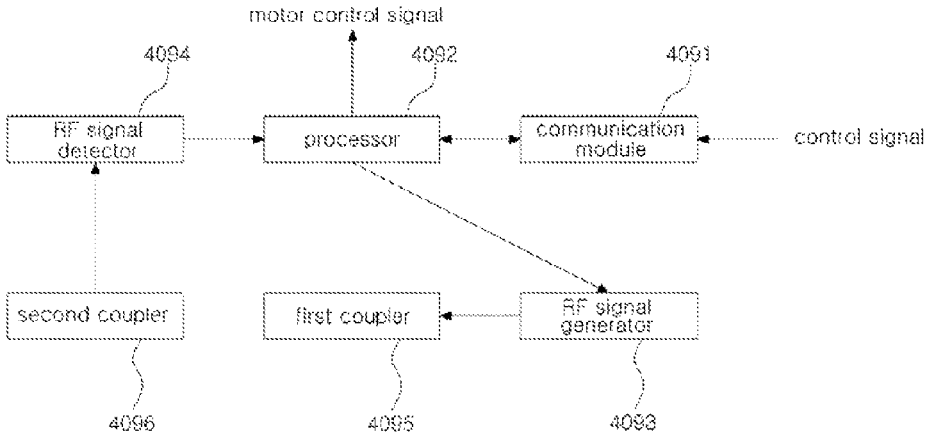
FIG. 6 is a block diagram illustrating the detailed composition of a circuit board according to an embodiment of the present invention.

FIG. 6 is a block diagram illustrating the detailed composition of a circuit board 4090 according to an embodiment of the present invention.

According to an embodiment of the present invention, the circuit board 4090 can include a communication module 4091, a processor 4092, an RF signal generator 4093, an RF signal detector 4094, a first coupler 4095, and a second coupler 4096.

The communication module 4091 may receive a control signal for controlling the sliding of the sliding members 4070. In this case, the control signal can be one that is sent from a control server installed in a remote location. In one example, the communication module 4091 can be an Ethernet module. Here, the control signal can include information on the frequency band or on the center frequency intended for tuning.

The processor 4092 may control the tuning operation based on the received control signal. The processor 4092 may control the tuning operation by generating a motor control signal for driving the motor and a control signal for controlling the RF signal generator.

The RF signal generator 4093 may serve to generate a particular designated frequency signal. A PLL chip, for example, can be used for the RF signal generator 4093. The RF signal generator 4093 may generate an RF signal of a particular frequency according to the control of the processor 4092. The processor 4092 may provide the RF signal generator 4093 with frequency information, such as 900 MHz, for example, at which the RF signal generator 4093 may generate a corresponding frequency signal.

The particular frequency signal generated at the RF signal generator 4093 may be coupled to the first coupler 4095. The first coupler 4095 can be implemented on the board in the form of a typical $\lambda/4$ coupler. The first coupler 4095 may be electrically connected with a central conductor of the input connector, so that the coupled signal may be provided to the input connector.

The second coupler 4096 may be electrically connected with the output connector of the filter unit, and may provide the RF signal detector 4094 with the output signal of the filter unit by way of coupling.

The RF signal detector 4094 is a device for detecting the power of an RF signal, and can employ, for example, an integrated circuit that converts RF power into a voltage value.

The RF signal detector 4094 may provide the processor 4092 with the power information of a particular detected frequency signal, and the processor 4092 may control the tuning action by using the power detected at the RF signal detector 4094.

The processor 4092 may determine whether or not a desired tuning is achieved by checking the power detected at the RF signal detector while rotating the motor by a preset reference number of revolutions (e.g. in the case of a step motor, one step).

For example, the processor 4092 can perform automatic tuning, by determining whether or not the detected power at the RF signal detector for a particular frequency fl reaches a preset reference value, while rotating the motor to move the sliding member, and completing the tuning if the preset reference value is reached.

Figure 7:
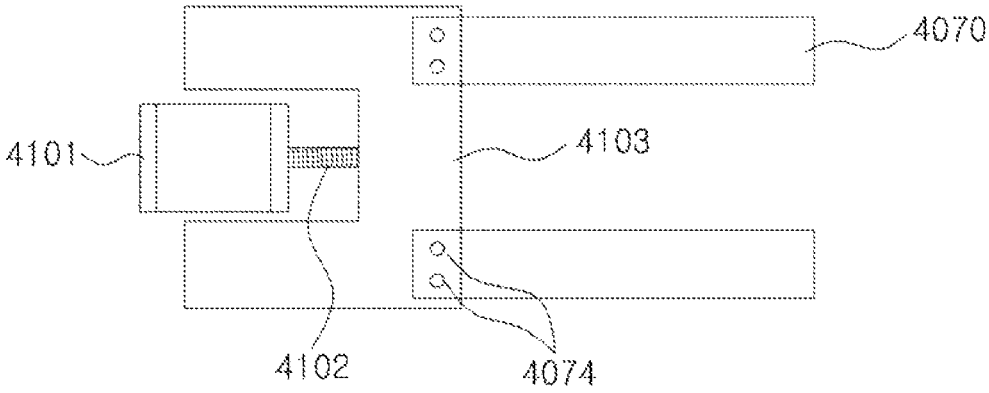
FIGS. 7 and 8 illustrate the joining of a sliding member and a driving unit according to an embodiment of the present invention.
Figure 8:
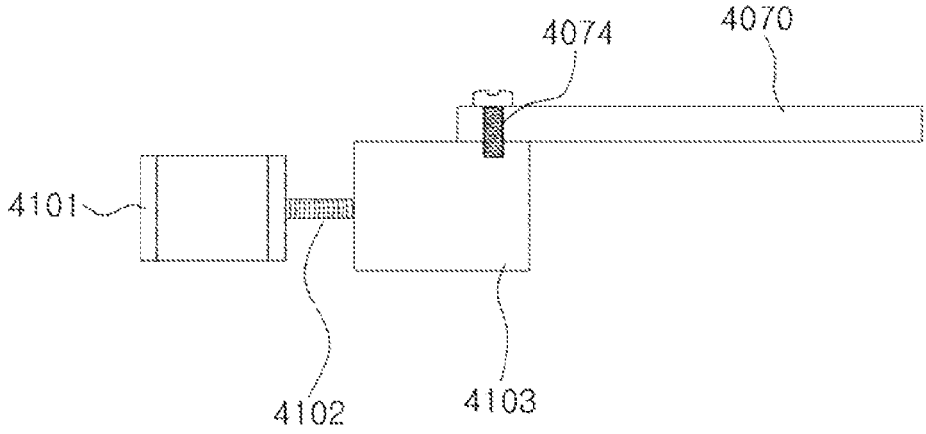

FIG. 7 is a plan view of the joint structure for a driving unit and a sliding member according to an embodiment of the present invention, and FIG. 8 is a cross-sectional view of the joint structure for a driving unit and a sliding member according to an embodiment of the present invention.

According to an embodiment of the present invention, the driving unit 4100 can include a motor 4101, a screw 4102, and an intermediary member 4103.

The motor 4101 may provide a rotational force, which may be provided to the screw 4102.

The screw 4102 may transform the rotational movement of the motor 4101 into horizontal movement, while the intermediary member 4103 may be joined to the screw 4102 and to the sliding members 4070 and may include a threaded hole to which the screw may be joined. The intermediary member may move along a horizontal direction in correspondence to the rotation of the screw 4102.

Joining holes 4074 may be formed in an upper portion of the intermediary member 4103 for joining with the sliding members 4070. Screw threads may be formed in the joining holes 4074, so that the intermediary member 4103 and the sliding members 4070 may be joined by screw-joining Of course, the joining method is not limited to screw-joining, and a variety of methods can be used. Also, one end of the sliding member 4070 may be joined to the intermediary member 4103, but the other end may not be secured. This is to allow free sliding.

The structure of the driving unit and the way it is joined to the sliding members described above are merely one example; the structure of the driving unit and the way it is joined to the sliding members can be modified in various ways by those skilled in the art.

For example, instead of the gear structure using the screw and intermediary member joined together as in FIG. 7 and FIG. 8, the driving unit can also use a motor in which the shaft of the motor itself moves in a horizontal direction in correspondence with the rotation of the motor.

The tuning action of a tunable filter according to a preferred embodiment of the present invention will be described below in more detail, with reference to FIG. 9.

Figure 9:
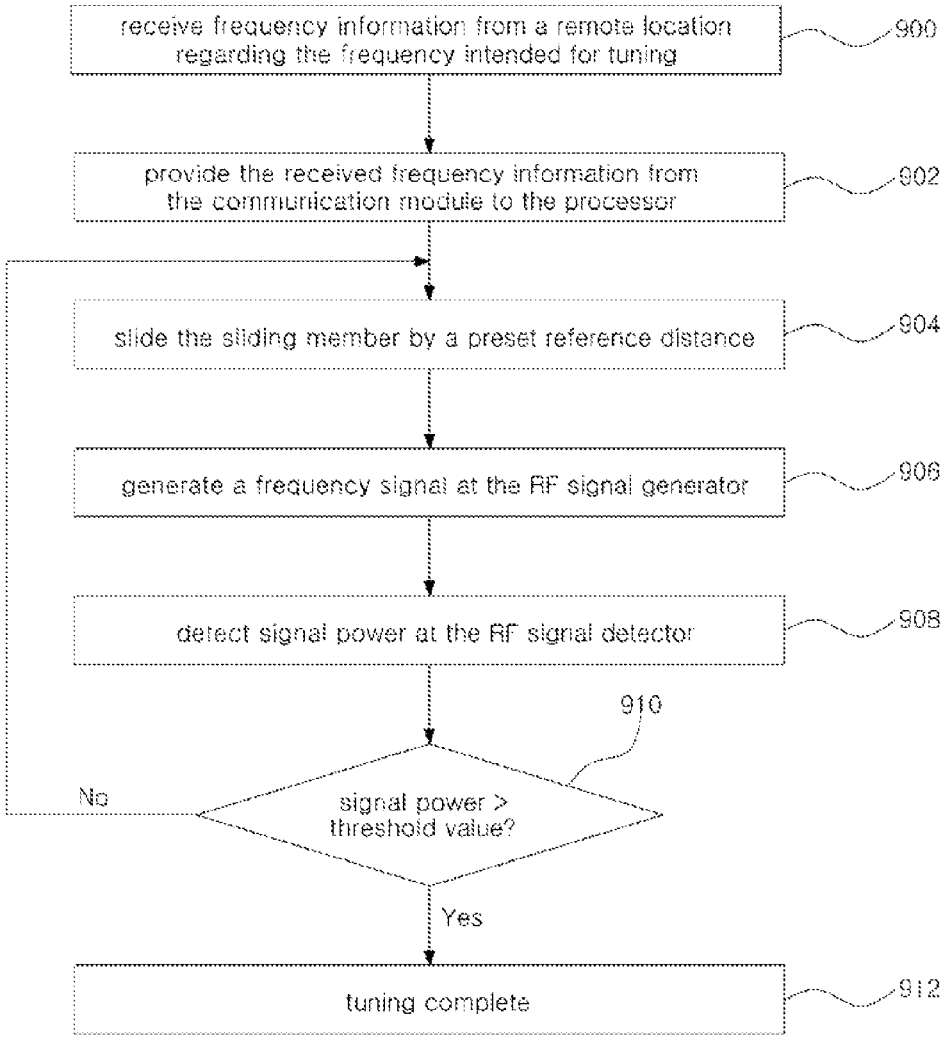
FIG. 9 is a flowchart illustrating the automatic tuning action of a tunable filter according to an embodiment of the present invention.

FIG. 9 is a flowchart illustrating the automatic tuning action of a tunable filter according to an embodiment of the present invention.

Referring to FIG. 9, the communication module 4091 may receive frequency information on the frequency intended for tuning from a remote location (step 900). Here, the frequency information on the frequency intended for tuning can include information on a center frequency of the frequency band intended for tuning.

The frequency information received at the communication module 4091 may be provided to the processor 4092 (step 902).

According to a first embodiment of the invention, when tuning request information is received at the communication module 4091, the processor 4092 can perform the tuning after converting the sliding members to their initial positions, and according to a second embodiment of the invention, the tuning can be performed with the sliding members at their current positions. Here, an initial position may refer to a position at which sliding is no longer possible in one of a first sliding direction and a second sliding direction.

The processor 4092, having received the frequency information from the communication module 4091 on the frequency intended for tuning, may provide the motor with a control signal for rotating the motor of the driving unit by a preset number of revolutions and may thereby slide the sliding members by a preset reference distance (step 904). Here, the preset number of revolutions can be one step in a step motor, for example, while the reference distance can be the distance by which the rotation of one step of the step motor moves the sliding members.

With the first embodiment, sliding is possible only in one of the two sliding directions, and as such, the processor may move the sliding member by a reference distance by outputting a motor control signal that causes the sliding member to slide in the corresponding slidable direction.

With the second embodiment, the processor may select a slidable direction from among the first direction and second direction in consideration of the current position of the sliding member and the frequency intended for tuning, and then move the sliding member by a reference distance by outputting a motor control signal that causes the sliding member to slide in the corresponding direction.

When the sliding member is moved by a reference distance, the processor 4092 may request the RF signal generator 4093 to generate a frequency signal corresponding to the received frequency information, and the RF signal generator 4093 may generate the corresponding frequency signal (step 906).

The frequency signal generated at the RF signal generator 4093 may be inputted through the first coupler 4095 to the filter unit, while the signal outputted through the output connector may be inputted through the second coupler to the RF signal detector 4094, so that the power of the signal may be detected at the RF signal detector (step 908).

The processor 4092 may determine whether or not the power of the RF signal detected at the RF signal detector 4094 is greater than a preset threshold value (step 910). If the power of the detected RF signal is greater than the preset threshold value, it may be determined that appropriate filtering is achieved for the frequency band intended for tuning, and the tuning operation may be completed (step 912).

If the power of the detected RF signal is not greater than the preset threshold value, then the tuning can continue with step 904 through step 910 repeated to move the sliding member by a reference distance.

While the present invention has been described with reference to particular embodiments, the embodiments above are for illustrative purposes only, provided to allow general understanding of the invention, and do not limit the invention. It is to be appreciated that various changes and modifications can be made by those skilled in the art without departing from the spirit and scope of the present invention, as defined by the appended claims and their equivalents. Such changes, modifications, and additions should be viewed as belonging to the scope of the invention as defined by the appended claims.

The invention claimed is:

1. A frequency tunable filter enabling automatic control, the frequency tunable filter comprising:

a filter unit having a sliding member so as to be capable of tuning a frequency band of a frequency signal being filtered;

a communication module configured to receive a control signal for controlling the tuning of the frequency band; and a control unit configured to control the tuning of the frequency band by moving the sliding member based on the control signal, wherein the control unit comprises:

a processor configured to provide a control such that the sliding member is moved by a preset reference distance when the control signal is received;

an RF signal generator configured to generate a frequency signal intended for tuning according to the control of the processor; and an RF signal detector configured to detect an output signal power of the filter unit for the frequency signal generated at the RF signal generator, wherein the processor is configured to compare a detected power of the RF signal detector with a preset threshold value and repeat the comparing of the detected power and the threshold value while moving the sliding member by the reference distance until the detected power is greater than the preset threshold value.

2. The frequency tunable filter enabling automatic control according to claim 1, wherein the control unit further comprises:

a first coupler configured to input the frequency signal generated at the RF signal generator to an input connector of the filter unit by way of coupling; and a second coupler configured to provide an output signal of the filter unit from an output connector of the filter unit to the RF signal detector by way of coupling.

3. The frequency tunable filter enabling automatic control according to claim 1, wherein the frequency signal intended for tuning is a center frequency signal of a frequency band intended for tuning.

4. The frequency tunable filter enabling automatic control according to claim 1, wherein the RF signal generator comprises a PLL chip.

5. A frequency tunable filter enabling automatic control, the frequency tunable filter comprising:

a filter unit having a sliding member so as to be capable of tuning a frequency band of a frequency signal being filtered;

a communication module configured to receive a control signal for controlling the tuning of the frequency band; and a control unit configured to control the tuning of the frequency band by moving the sliding member based on the control signal, wherein the communication module receives the control signal from a control server positioned in a remote location and comprises an Ethernet module.

6. The frequency tunable filter enabling automatic control according to claim 1, wherein the sliding member is joined to a motor to slide in correspondence with a rotation of the motor, and the processor controls a driving of the motor to move the sliding member by the reference distance.

7. A frequency tunable filter enabling automatic control, the frequency tunable filter comprising:

a filter unit having a sliding member so as to be capable of tuning a frequency band of a frequency signal being filtered;

a processor configured to provide a control such that the sliding member is moved by a preset reference distance according to a control signal for tuning to the particular frequency band;

an RF signal generator configured to generate a frequency signal intended for tuning according to the control of the processor; and an RF signal detector configured to detect an output signal power of the filter unit for the frequency signal generated at the RF signal generator, wherein the processor is configured to compare a detected power of the RF signal detector with a preset threshold value and repeat the comparing of the detected power and the threshold value while moving the sliding member by the reference distance until the detected power is greater than the preset threshold value.

8. The frequency tunable filter enabling automatic control according to claim 7, further comprising a communication module, wherein the control signal is transmitted from a server in a remote location and received by the communication module.

9. The frequency tunable filter enabling automatic control according to claim 7, further comprising:

a first coupler configured to input the frequency signal generated at the RF signal generator to an input connector of the filter unit by way of coupling; and a second coupler configured to provide an output signal of the filter unit from an output connector of the filter unit to the RF signal detector by way of coupling.

10. The frequency tunable filter enabling automatic control according to claim 7, wherein the frequency signal intended for tuning is a center frequency signal of a frequency band intended for tuning.

11. An automatic filter tuning method in a tunable filter equipped with a filter unit, a processor, an RF signal generator, an RF signal detector, and a sliding member, the method comprising:

(a) providing to the processor a control signal for tuning, the control signal including information of a frequency band intended for tuning;

(b) moving the sliding member by a preset reference distance by way of a control of the processor;

(c) generating a frequency signal at the RF signal generator corresponding to the frequency band intended for tuning, and inputting the frequency signal to the filter unit; and (d) detecting a power of an output signal of the filter unit at the RF signal detector and comparing the power of the output signal with a preset threshold value, wherein tuning is completed if, in said step (d) of comparing the detected power with the preset threshold value, the detected power exceeds the preset threshold value, and if the detected power does not exceed the preset threshold value, said step (b) through said step (d) are repeated to determine whether or not appropriate tuning is achieved.

12. The automatic filter tuning method in a tunable filter according to claim 11, wherein the control signal is received from a server in a remote location.

* * * * *